US008851163B2

(12) United States Patent
Nguyen

(10) Patent No.: US 8,851,163 B2
(45) Date of Patent: Oct. 7, 2014

(54) MULTIPLE OFFSET SLIM CONNECTOR

(75) Inventor: Dennis P. Nguyen, Pearland, TX (US)

(73) Assignee: Cameron International Corporation, Houston, TX (US)

( * ) Notice: Subject to any disclaimer, the term of this patent is extended or adjusted under 35 U.S.C. 154(b) by 322 days.

(21) Appl. No.: 13/144,284

(22) PCT Filed: Feb. 18, 2010

(86) PCT No.: PCT/US2010/024554
§ 371 (c)(1),
(2), (4) Date: Jul. 12, 2011

(87) PCT Pub. No.: WO2010/110967
PCT Pub. Date: Sep. 30, 2010

(65) Prior Publication Data

US 2012/0048573 A1 Mar. 1, 2012

Related U.S. Application Data

(60) Provisional application No. 61/164,366, filed on Mar. 27, 2009.

(51) Int. Cl.
*E21B 19/16* (2006.01)
*E21B 33/038* (2006.01)

(52) U.S. Cl.
CPC ..... *E21B 33/038* (2013.01)
USPC ..... 166/75.13; 166/379

(58) Field of Classification Search
USPC ..... 166/380, 77.51, 379, 75.13, 97.5; 285/123.2, 123.1, 333
See application file for complete search history.

(56) References Cited

U.S. PATENT DOCUMENTS

| | | | | | |
|---|---|---|---|---|---|
| 3,011,552 | A | * | 12/1961 | Rhodes et al. | 166/67 |
| 3,025,083 | A | * | 3/1962 | Lebeaux | 285/18 |
| 3,097,869 | A | * | 7/1963 | Allen et al. | 285/123.2 |
| 3,177,013 | A | * | 4/1965 | Rector | 285/123.2 |
| 3,421,580 | A | | 1/1969 | Fowler et al. | |
| 3,974,875 | A | * | 8/1976 | Herd et al. | 166/367 |
| 4,192,383 | A | | 3/1980 | Kirkland et al. | |
| 4,260,022 | A | | 4/1981 | Van Bilderbeek | |

(Continued)

FOREIGN PATENT DOCUMENTS

| | | |
|---|---|---|
| GB | 2004341 | 3/1979 |
| GB | 2261271 | 5/1993 |
| WO | WO2008154076 | 12/2008 |

OTHER PUBLICATIONS

PCT Search Report and Written Opinion of PCT Application No. PCT/US2010/024554 mailed Sep. 3, 2010.

*Primary Examiner* — Daniel P Stephenson
(74) *Attorney, Agent, or Firm* — Fletcher Yoder P.C.

(57) ABSTRACT

A system, in certain embodiments, includes a wellhead connector configured to connect with multiple wellheads within a single wellhead conductor. The system may also include a hold down ring configured to be positioned radially around the wellhead connector and to lock the wellhead connector in position axially on top of the multiple wellheads by applying an axially downward force onto the wellhead connector. In addition, the system may include a body lock ring configured to be positioned radially around the multiple wellheads. The system may also include a union ring configured to be positioned radially around both the hold down ring and the body lock ring and to lock the hold down ring and the body lock ring in position adjacent each other axially.

27 Claims, 8 Drawing Sheets

(56) References Cited

U.S. PATENT DOCUMENTS

| | | | | | |
|---|---|---|---|---|---|
| 4,284,142 | A * | 8/1981 | Kirkland | 166/344 |
| 4,333,531 | A * | 6/1982 | Lawson | 166/341 |
| 4,736,799 | A * | 4/1988 | Ahlstone | 166/348 |
| 4,745,971 | A * | 5/1988 | Akkerman | 166/120 |
| 4,749,046 | A * | 6/1988 | Gano | 166/366 |
| 4,770,247 | A * | 9/1988 | Wilkins | 166/341 |
| 4,796,698 | A * | 1/1989 | Gano | 166/135 |
| 5,494,110 | A * | 2/1996 | Appleford | 166/339 |
| 5,732,772 | A * | 3/1998 | Borak et al. | 166/75.14 |
| 6,695,356 | B2 | 2/2004 | Nguyen et al. | |
| 6,857,471 | B2 * | 2/2005 | Thangarasu et al. | 166/75.14 |
| 7,264,067 | B2 * | 9/2007 | Glaser et al. | 175/61 |
| 2002/0070030 | A1 * | 6/2002 | Smith et al. | 166/379 |
| 2010/0126729 | A1 * | 5/2010 | Tunget | 166/313 |
| 2010/0183360 | A1 * | 7/2010 | Nguyen et al. | 403/14 |
| 2011/0226487 | A1 * | 9/2011 | Vanderford et al. | 166/381 |
| 2012/0048534 | A1 * | 3/2012 | Hanlin et al. | 166/84.1 |
| 2012/0048573 | A1 * | 3/2012 | Nguyen | 166/380 |

* cited by examiner

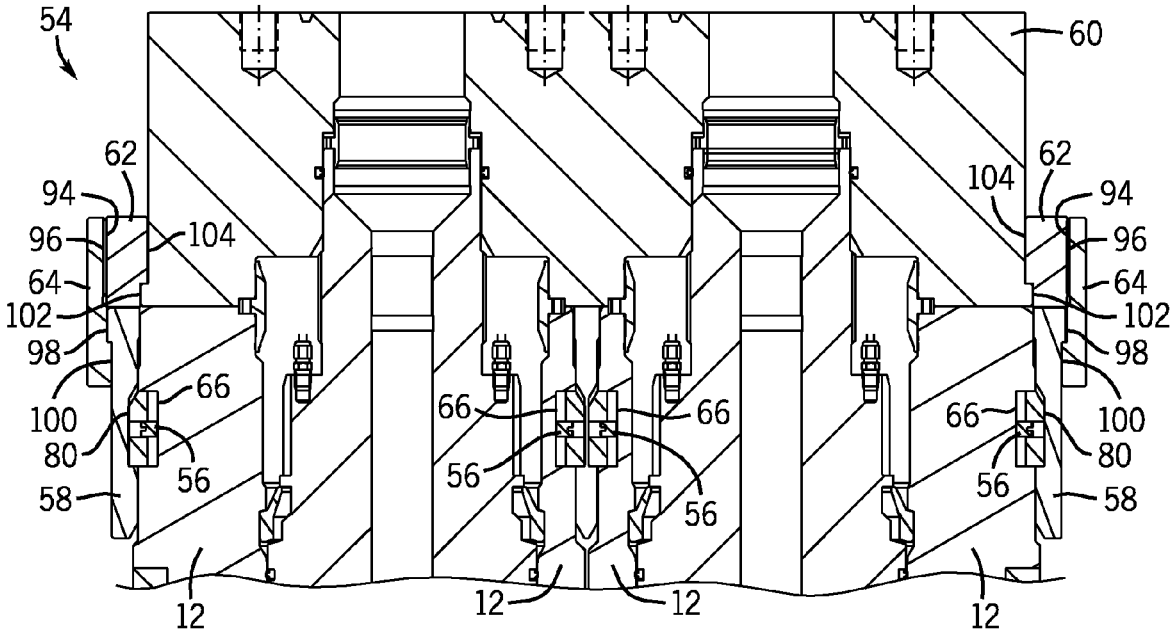
FIG. 4
FIG. 5
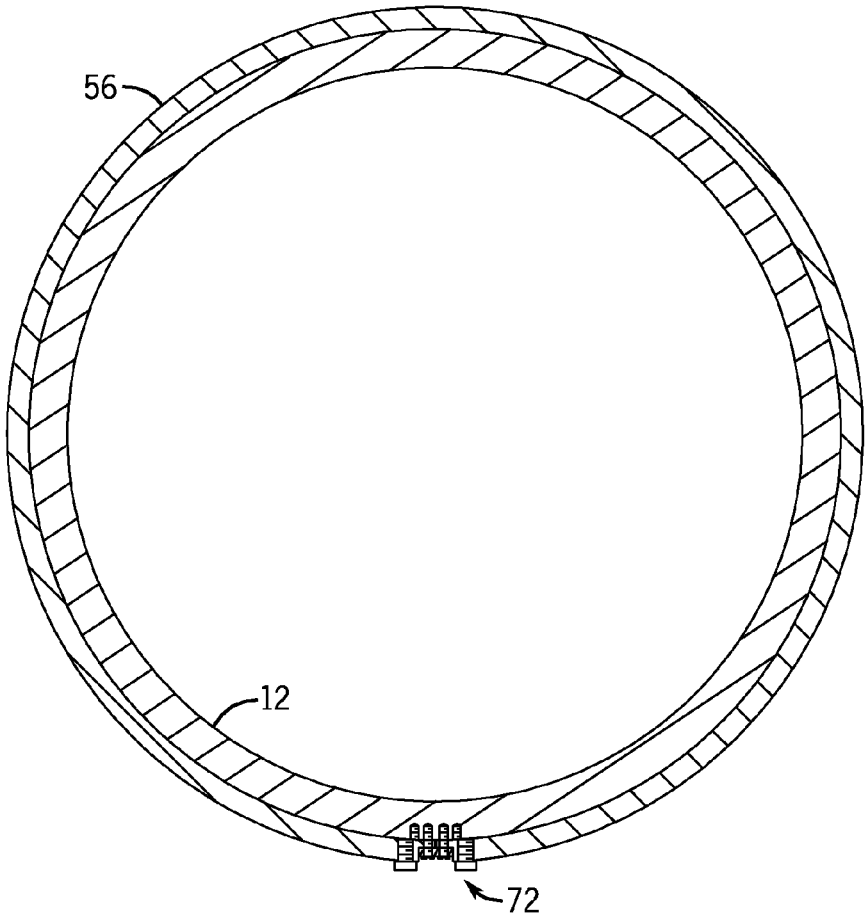

MULTIPLE OFFSET SLIM CONNECTOR

CROSS-REFERENCE TO RELATED APPLICATIONS

This application claims priority to and benefit of PCT Patent Application No. PCT/US2010/024554, entitled "Multiple Offset Slim Connector," filed Feb. 18, 2010, which is herein incorporated by reference in its entirety, and which claims priority to and benefit of U.S. Provisional Patent Application No. 61/164,366, entitled "Multiple Offset Slim Connector", filed on Mar. 27, 2009, which is herein incorporated by reference in its entirety.

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

Natural resources, such as oil and gas, are used as fuel to power vehicles, heat homes, and generate electricity, in addition to a myriad of other uses. Once a desired resource is discovered below the surface of the earth, drilling and production systems are often employed to access and extract the resource. These systems may be located onshore or offshore depending on the location of a desired resource. Further, such systems generally include a wellhead assembly through which the resource is extracted. These wellhead assemblies may include a wide variety of components and/or conduits, such as casings, trees, manifolds, and so forth, which facilitate drilling and/or extraction operations. A long pipe, such as a casing, may be lowered into the earth to enable access to the natural resource. Additional pipes and/or tubes may then be run through the casing to facilitate extraction of the resource. Therefore, these wellhead assemblies are frequently associated with numerous associated components and/or conduits which can take up a considerable amount of space and can be somewhat costly. As such, it may be desirable to provide certain components and/or conduits which may be shared among multiple wellhead assemblies.

BRIEF DESCRIPTION OF THE DRAWINGS

Various features, aspects, and advantages of the present invention will become better understood when the following detailed description is read with reference to the accompanying figures in which like characters represent like parts throughout the figures, wherein:

FIG. 4 is a cross-sectional side view of an exemplary embodiment of a conductor sharing wellhead (CSW) adapter system and its associated components;

FIG. 5 is a cross-sectional top view of an exemplary wellhead lock ring;

DETAILED DESCRIPTION OF SPECIFIC EMBODIMENTS

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Certain exemplary embodiments of the present invention include systems and methods for connecting multiple wellheads within a single conductor. In particular, in certain embodiments, a multiple offset slim connector may be provided which is configured to connect multiple wellheads within the single conductor. The ability to connect multiple wellheads within a single connector may enable the sharing of certain redundant components between the wellheads. In addition, redundant space between the multiple wellheads may be reduced in that multiple connectors will not be needed on top of the wellheads.

Figure 1:
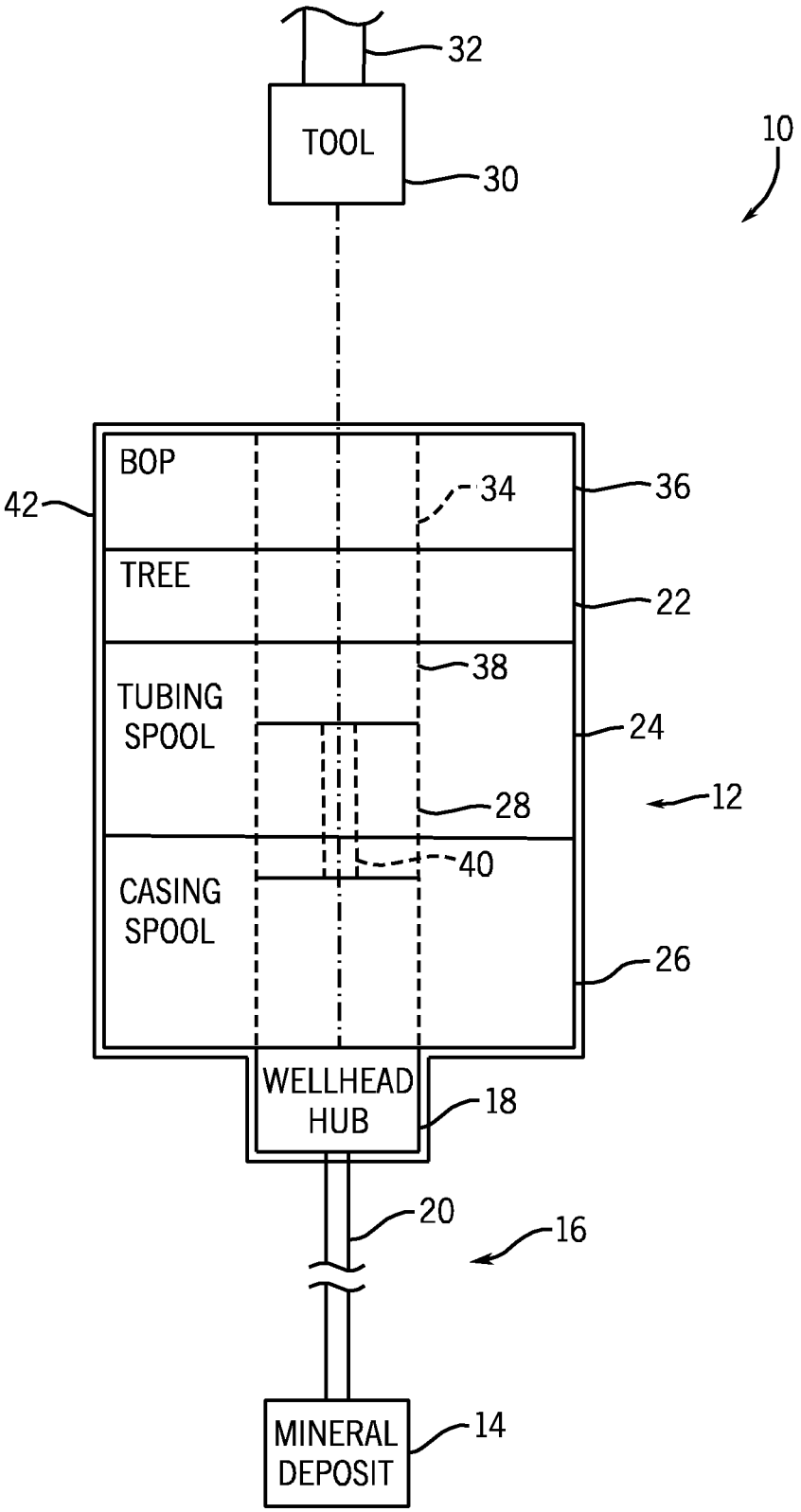
FIG. 1 is a block diagram illustrating a mineral extraction system in accordance with an embodiment of the present invention.

FIG. 1 is a block diagram that illustrates an embodiment of a mineral extraction system 10. The illustrated mineral extraction system 10 may be configured to extract various minerals and natural resources, including hydrocarbons (e.g., oil and/or natural gas), from the earth, or to inject substances into the earth. In some embodiments, the mineral extraction system 10 is land-based (e.g., a surface system) or sub-sea (e.g., a sub-sea system). As illustrated, the system 10 includes a wellhead 12 coupled to a mineral deposit 14 via a well 16. The well 16 may include a wellhead hub 18 and a well bore 20. The wellhead hub 18 generally includes a large diameter hub disposed at the termination of the well bore 20 and designed to connect the wellhead 12 to the well 16.

The wellhead 12 may include multiple components that control and regulate activities and conditions associated with the well 16. For example, the wellhead 12 generally includes bodies, valves, and seals that route produced minerals from the mineral deposit 14, regulate pressure in the well 16, and inject chemicals down-hole into the well bore 20. In the illustrated embodiment, the wellhead 12 includes what is colloquially referred to as a Christmas tree 22 (hereinafter, a tree), a tubing spool 24, a casing spool 26, and a hanger 28 (e.g., a tubing hanger and/or a casing hanger). The system 10 may include other devices that are coupled to the wellhead 12, and devices that are used to assemble and control various components of the wellhead 12. For example, in the illustrated embodiment, the system 10 includes a running tool 30 suspended from a drill string 32. In certain embodiments, the running tool 30 includes a running tool that is lowered (e.g., run) from an offshore vessel to the well 16 and/or the wellhead 12. In other embodiments, such as surface systems, the running tool 30 may include a device suspended over and/or lowered into the wellhead 12 via a crane or other supporting device.

The tree 22 generally includes a variety of flow paths (e.g., bores), valves, fittings, and controls for operating the well 16. For instance, the tree 22 may include a frame that is disposed about a tree body, a flow-loop, actuators, and valves. Further, the tree 22 may provide fluid communication with the well 16. For example, the tree 22 includes a tree bore 34. The tree bore 34 provides for completion and workover procedures, such as the insertion of tools into the well 16, the injection of various chemicals into the well 16, and so forth. Further, minerals extracted from the well 16 (e.g., oil and natural gas) may be regulated and routed via the tree 22. For instance, the tree 22 may be coupled to a jumper or a flowline that is tied back to other components, such as a manifold. Accordingly, produced minerals flow from the well 16 to the manifold via the wellhead 12 and/or the tree 22 before being routed to shipping or storage facilities. A blowout preventer (BOP) 36 may also be included, either as a part of the tree 22 or as a separate device. The BOP 36 may consist of a variety of valves, fittings, and controls to prevent oil, gas, or other fluid from exiting the well in the event of an unintentional release of pressure or an overpressure condition.

The tubing spool 24 provides a base for the tree 22. Typically, the tubing spool 24 is one of many components in a modular sub-sea or surface mineral extraction system 10 that is run from an offshore vessel or surface system. The tubing spool 24 includes a tubing spool bore 38. The tubing spool bore 38 connects (e.g., enables fluid communication between) the tree bore 34 and the well 16. Thus, the tubing spool bore 38 may provide access to the well bore 20 for various completion and workover procedures. For example, components can be run down to the wellhead 12 and disposed in the tubing spool bore 38 to seal off the well bore 20, to inject chemicals down-hole, to suspend tools down-hole, to retrieve tools down-hole, and so forth.

The well bore 20 may contain elevated pressures. For example, the well bore 20 may include pressures that exceed 10,000, 15,000, or even 20,000 pounds per square inch (psi). Accordingly, the mineral extraction system 10 may employ various mechanisms, such as seals, plugs, and valves, to control and regulate the well 16. For example, plugs and valves are employed to regulate the flow and pressures of fluids in various bores and channels throughout the mineral extraction system 10. For instance, the illustrated hanger 28 (e.g., tubing hanger or casing hanger) is typically disposed within the wellhead 12 to secure tubing and casing suspended in the well bore 20, and to provide a path for hydraulic control fluid, chemical injections, and so forth. The hanger 28 includes a hanger bore 40 that extends through the center of the hanger 28, and that is in fluid communication with the tubing spool bore 38 and the well bore 20. One or more seal assemblies and/or landing assemblies may be disposed between the hanger 28 and the tubing spool 24 and/or the casing spool 26.

In typical mineral extraction systems 10, the wellhead 12 may allow for extraction of minerals from only one well 16. However, it may also be possible to incorporate multiple wellheads 12 within a common casing (i.e., "conductor") 42. In other words, in certain embodiments, the conductor 42 may be configured to allow for the extraction of minerals and natural resources through a plurality of mineral deposits 14 and wells 16 using a plurality of wellheads 12. Therefore, multiple wells 16 may be drilled and completed simultaneously within a single conductor 42. These types of wellheads 12 may be referred to as conductor sharing wellheads (CSWs). The conductor 42 may incorporate two, three, or even up to four independent wells 16 within a single conductor 42. Using CSWs, each well 16 may be drilled and completed independently; however, the number of connections may be minimized. Advantages of using multiple CSWs 12 within a single conductor 42 may include smaller platform sizes and maximized use of existing platform slots; lower site development costs in land applications; reduced installation times; independent drilling and completion of each well 16, allowing access to a well 16 during decompletion of an adjacent well 16; elimination of the need for commitment to subsequent wells 16 at the time of the first well 16; and so forth.

Figure 2:
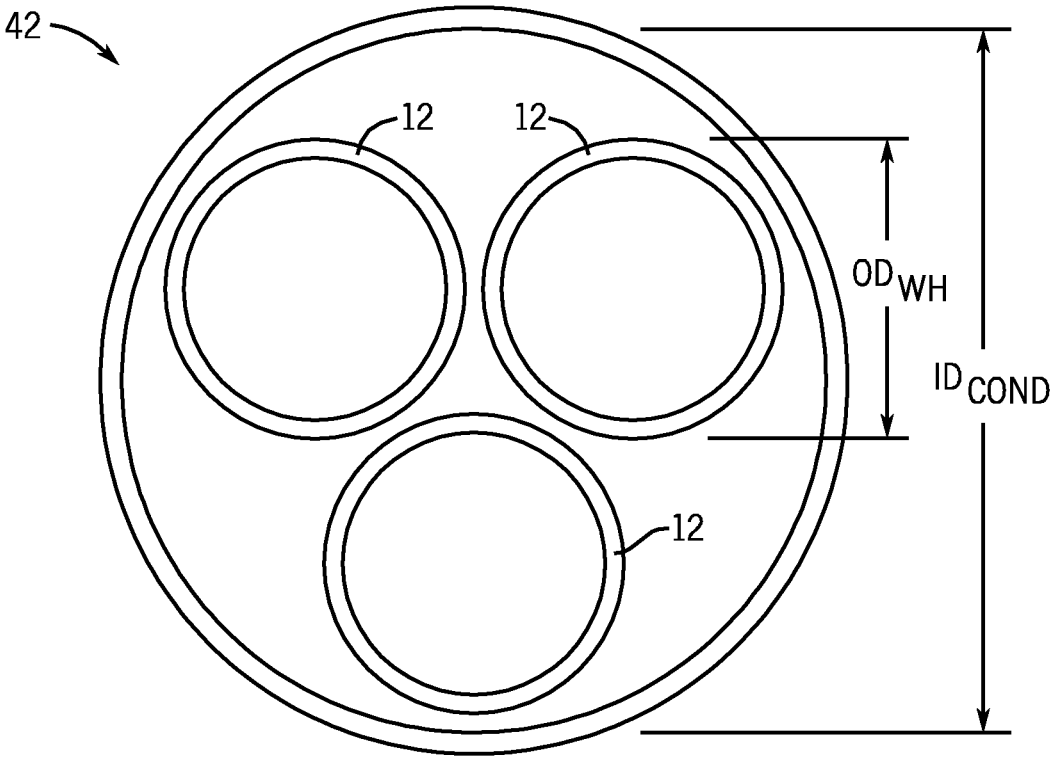
FIG. 2 is a cross-sectional top view of a conductor incorporating three independent completions.

However, space constraints may become an important design consideration when using multiple CSWs 12 within a single conductor 42. For instance, for illustrative purposes, FIG. 2 depicts a cross-sectional top view of a conductor 42 incorporating three independent wellheads 12, although any number of independent wellheads 12 may be used (e.g., 2, 3, 4, 5, and so forth). As illustrated, the maximum available outer diameter $OD_{WH}$ of the wellheads 12 may only be in the range of approximately 20-50% of the inner diameter $ID_{COND}$ of the conductor 42, depending on the number and size of the wellheads 12 used. For instance, in a certain embodiment, if the inner diameter $ID_{COND}$ of the conductor 42 is approximately 22 inches (e.g., in a conductor 42 having an outer diameter of 24 inches), the maximum available outer diameter $OD_{WH}$ for the three wellheads 12 may only be approximately 9 inches full bore. In addition, as described in greater detail below, due at least in part to additional equipment (e.g., seal assemblies, landing assemblies, and so forth) within each wellhead 12, the space available for each wellhead 12 may be further reduced. As such, the ability to minimize the space between each wellhead 12 within the conductor 42 may result in reduced operating costs and/or increased throughput from the wellheads 12.

Figure 3:
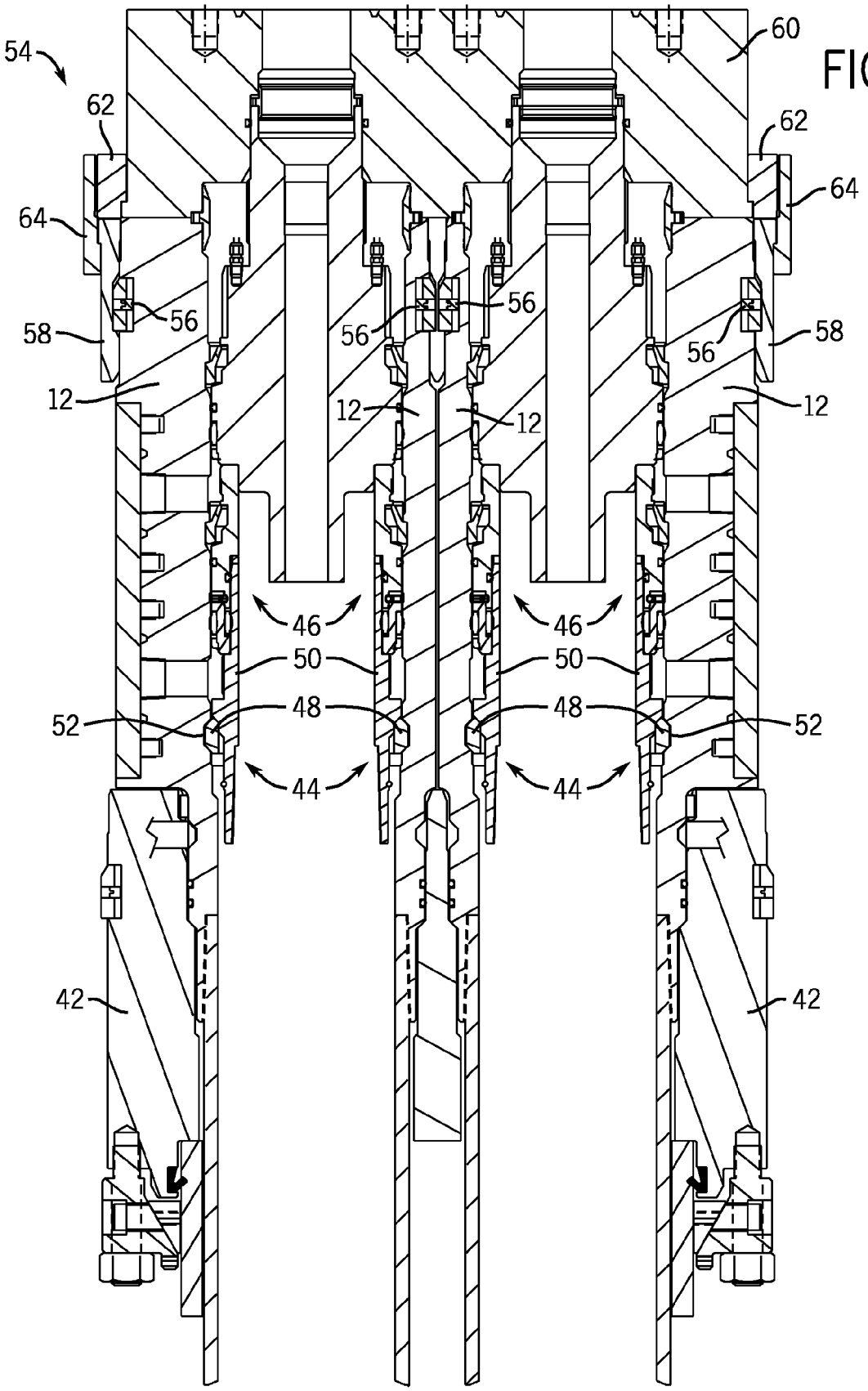
FIG. 3 is a cross-sectional side view of an exemplary embodiment of the conductor incorporating two wellheads.

FIG. 3 depicts a cross-sectional side view of an exemplary embodiment of the conductor 42 incorporating two wellheads 12. However, as described above, the conductor 42 may incorporate two, three, and even up to four wellheads 12. As illustrated, each of the two wellheads 12 may be associated with their own landing assemblies 44 and sealing assemblies 46. In particular, the landing assemblies 44 may include, among other things, landing rings which may be used to land a hanger 50 of each respective wellhead 12 in place within its wellhead 12. More specifically, in certain embodiments, the landing rings may radially engage with recesses 52 (e.g., annular grooves) of the wellhead 12.

As described above, the conductor 42 may be configured such that the multiple wellheads 12 fit within the conductor 42 in an efficient spatial configuration. The components that may facilitate this efficient spatial sharing of multiple wellheads 12 within a single conductor 42 may be collectively referred to as a CSW adapter system 54. The CSW adapter system 54 may include, among other things, a wellhead lock ring 56 associated with each respective wellhead 12, a body lock ring 58, a multiple offset slim connector 60, an optional hold down ring 62, and a union ring 64. The hold down ring 62 is optional because, in certain embodiments, the multiple offset slim connector 60 and the hold down ring 62 may be integrated into one piece.

As described in greater detail below, the multiple offset slim connector 60 may be configured to connect to multiple wellheads 12 in a single conductor 42. In particular, the multiple offset slim connector 60 may be configured so as to address the space limitations described in FIG. 2 above. More specifically, bores in the multiple offset slim connector 60 which are configured to mate with the wellheads 12 may be offset a certain amount to enable the wellheads 12 to share space within the conductor 42 which would otherwise be wasted. For instance, instead of requiring each of the wellheads 12 to be associated with its own respective body lock ring, the CSW adapter system 54 uses one common body lock ring 58, which enables the bores of the multiple offset slim connector 60 to be offset (e.g., closer together). As such, the wellheads 12 may also be closer together, reducing wasted space within the conductor 42.

FIG. 4 depicts a cross-sectional side view of an exemplary embodiment of the CSW adapter system 54 and its associated components. The first step for securing the multiple wellheads 12 within the CSW adapter system 54 may be to lock the wellheads 12 in place within the single body lock ring 58 of the CSW adapter system 54. As described above, each of the individual wellheads 12 may be associated with their own respective wellhead lock rings 56. The wellhead lock rings 56 may initially fit within recesses 66 of their respective wellheads 12, as illustrated in FIG. 4. The body lock ring 58 of the CSW adapter system 54 may be lowered axially down around the multiple wellheads 12. Since the wellhead lock rings 56 initially fit within the recesses 66 of their respective wellheads 12, sufficient clearance around the wellheads 12 may be provided for the body lock ring 58 to be lowered into position around the wellheads 12.

Figure 6:
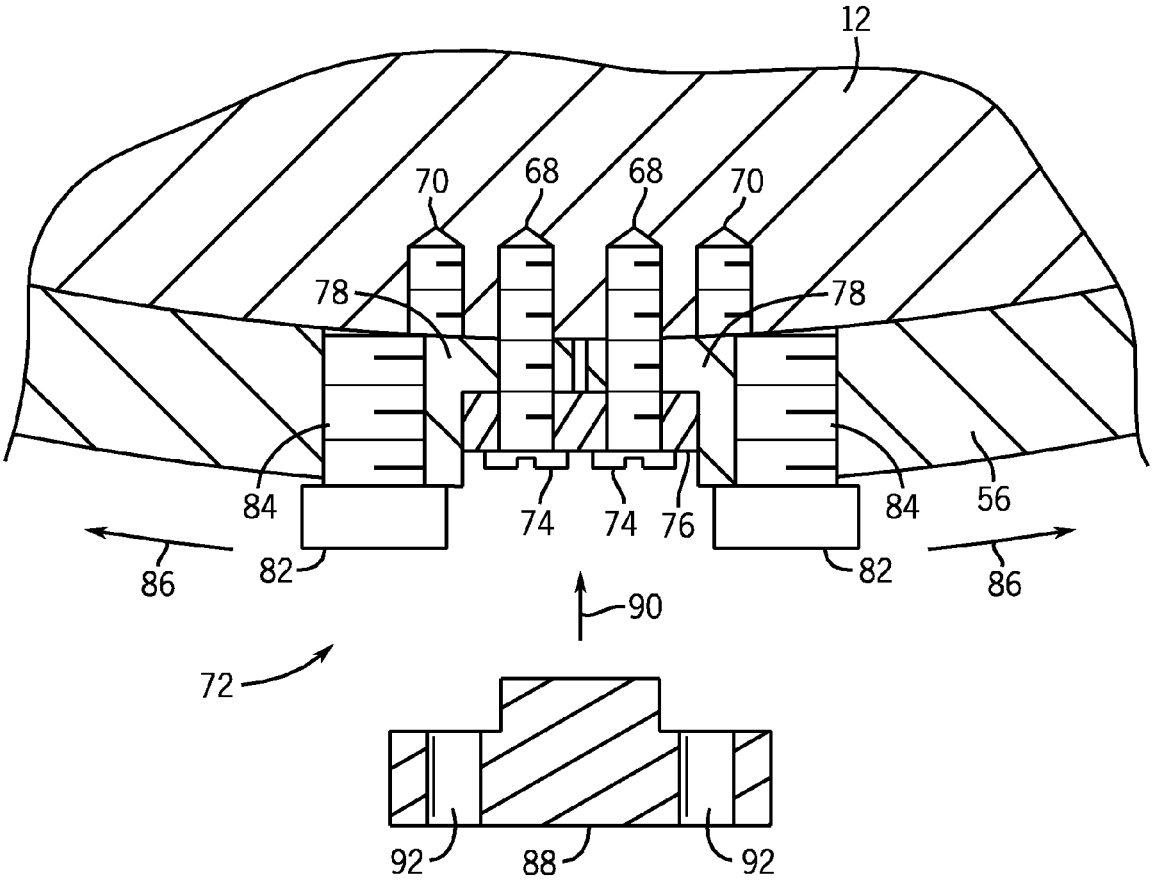
FIG. 6 is a partial cross-sectional top view of an exemplary wellhead lock ring.

FIGS. 5 and 6 depict an exemplary embodiment of the wellhead lock rings 56. In particular, FIG. 5 depicts a cross-sectional top view of an exemplary wellhead lock ring 56. In addition, FIG. 6 depicts a partial cross-sectional top view of an exemplary wellhead lock ring 56. The wellhead lock rings 56 may include a generally rectangular cross section which may be configured to fit within recesses 66 of each respective wellhead 12, as shown in FIG. 4. As illustrated in greater detail in FIG. 6, the wellheads 12 may, for instance, include a first and second set of threaded holes 68 and 70 in the recesses 66. The wellhead lock rings 56 may include locking mechanisms 72 which include threaded fasteners 74, which may be used to tighten the wellhead lock rings 56 by engaging the first set of threaded holes 68 to ensure that they remain in a fixed location relative to their respective wellheads 12. Spacer blocks 76 may also be used to provide rigidity to the open ends 78 of the wellhead lock rings 56.

As the body lock ring 58 is lowered into position around the wellheads 12, the wellhead lock rings 56 may be rotated and aligned within the body lock ring 58 such that the locking mechanisms 72 are aligned within inspection windows 80 within the body lock ring 58, as shown in FIG. 4. The inspection windows 80 enable manipulation of the locking mechanisms 72 which may radially expand the wellhead lock rings 56 such that their respective wellheads 12 remain in position within the body lock ring 58. Once in an aligned position with the body lock ring 58, the threaded fasteners 74 and spacer blocks 76 may be removed. At this point, as illustrated in FIG. 6, threaded studs or eyebolts 82 may then be threaded into threaded holes 84 adjacent the open ends 78 of the wellhead lock rings 56.

Then, the wellhead lock rings 56 may be spread circumferentially apart, as illustrated by arrows 86, until wedge blocks 88 may be inserted circumferentially between the open ends 78 of the wellhead lock rings 56, as illustrated by arrow 90. At this point, the wedge blocks 88 may be secured to the wellheads 12 with the threaded fasteners 74 by engaging the second set of threaded holes 70 of their respective wellhead 12. This may be further facilitated by fastener holes 92 in the wedge block 88. This may ensure that the wellhead lock rings 56 stay in an expanded position within the recesses 66 of the wellheads 12, ensuring that the wellheads 12 remain in position relative to the body lock ring 58. In addition, to remove the body lock ring 58 from the wellheads 12 at a later time, the wedge blocks 88 may be removed and the wellhead lock rings 56 may be secured in their circumferentially retracted positions with the threaded fasteners 74 engaging the first set of threaded holes 68.

Once the body lock ring 58 is secured around the multiple wellheads 12, the multiple offset slim connector 60 may be positioned axially on top of the multiple wellheads 12. The multiple offset slim connector 60 may be configured to mate with the specific number and type of wellheads 12 used. For instance, returning to FIG. 4, the illustrated multiple offset slim connector 60 is configured to mate with two wellheads 12. However, in certain embodiments, the multiple offset slim connector 60 may be configured to mate with two, three, or four wellheads 12.

Once the multiple offset slim connector 60 has been lowered axially onto the multiple wellheads 12, the hold down ring 62 may be axially lowered around the multiple offset slim connector 60. Again, in certain embodiments, the multiple offset slim connector 60 and the hold down ring 62 may be integrated into one piece. However, in embodiments where the multiple offset slim connector 60 and the hold down ring 62 are separate pieces, the hold down ring 62 is used to hold the multiple offset slim connector 60 down onto the multiple wellheads 12. In particular, the hold down ring 62 is configured to mate with the union ring 64, which fits around the body lock ring 58. More specifically, threading 94 on a radially outward face of the hold down ring 62 may be configured to mate with threading 96 on a radially inward face of the union ring 64.

A lip 98 on a radially outward face of the body lock ring 58 may be configured to mate with a notch 100 on a radially inward face of the union ring 64. Through the lip 98 and the notch 100, the union ring 64 may exert an axially upward force on the body lock ring 58 when the hold down ring 62 and the union ring 64 are engaged together via the threading 94, 96 of the hold down ring 62 and the union ring 64, respectively. Similarly, a lip 102 on a radially outward face of the multiple offset slim connector 60 may be configured to mate with a notch 104 on a radially inward face of the hold down ring 62. Through the lip 102 and the notch 104, the hold down ring 62 may exert an axially downward force on the multiple offset slim connector 60 when the hold down ring 62 and the union ring 64 are engaged together via the threading 94, 96 of the hold down ring 62 and the union ring 64, respectively. In general, the hold down ring 62 and the union ring 64 may be coupled together by a relatively small amount of rotational translation via the threading 94, 96 of the hold down ring 62 and the union ring 64, respectively. For instance, in certain embodiments, only a quarter-turn (e.g., 90 degree turn) or a half-turn (e.g., 180 degree turn) of the hold down ring 62 relative to the union ring 64 may be needed to ensure that the multiple offset slim connector 60 is locked in place on top of the multiple wellheads 12.

Figure 7:
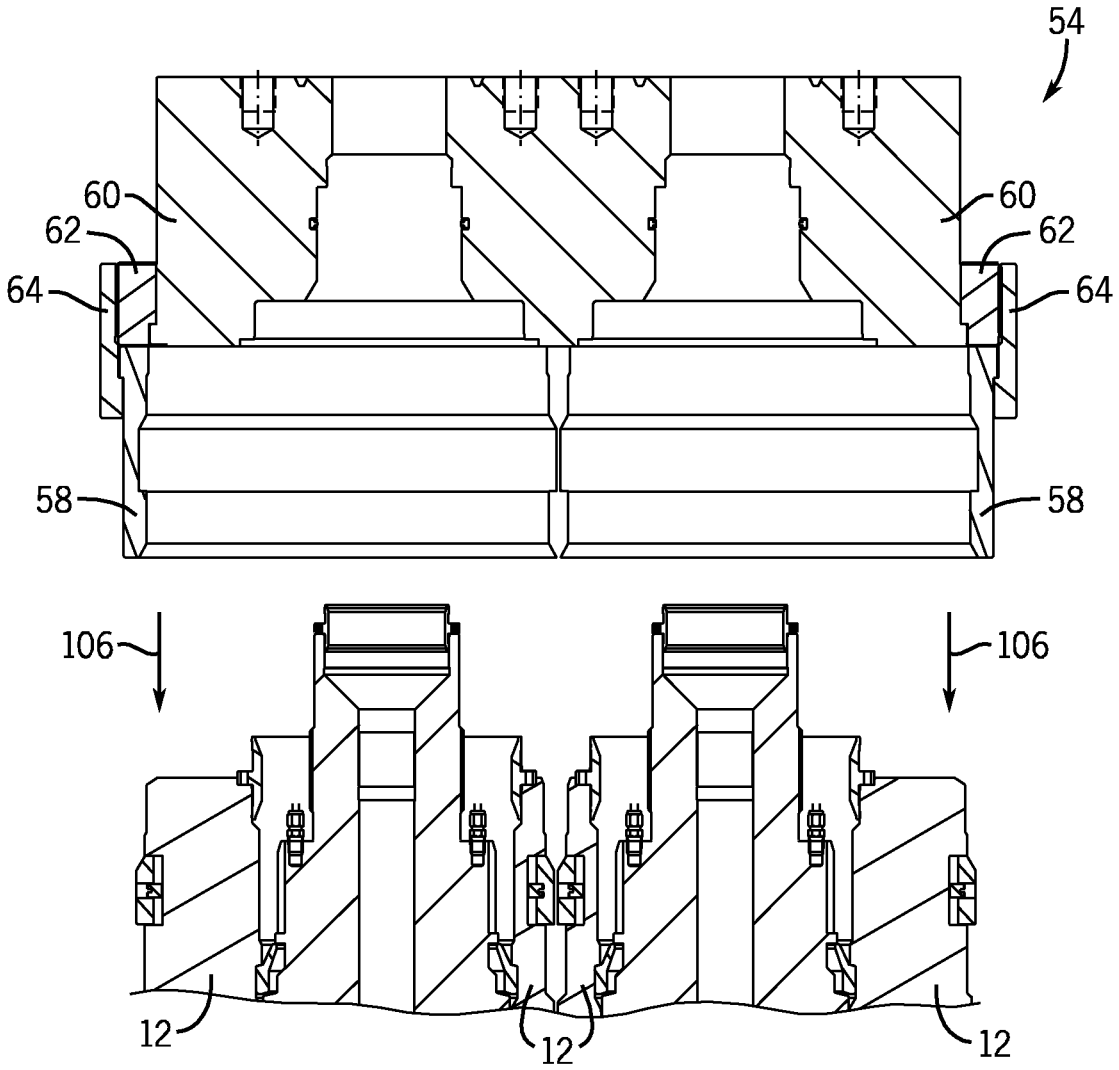
FIG. 7 is a cross-sectional side view of an exemplary embodiment of the CSW adapter system and its associated components, separated from the multiple wellheads.

FIG. 7 depicts a cross-sectional side view of an exemplary embodiment of the CSW adapter system 54 and its associated components, separated from the multiple wellheads 12. As illustrated, the CSW adapter system 54 includes the body lock ring 58, the multiple offset slim connector 60, the optional hold down ring 62, and the union ring 64. As described above, only one of each of these components are used with the CSW adapter system 54, as opposed to the wellhead lock rings 56, which may be used for each individual wellhead 12. This is because the multiple offset slim connector 60 is configured to mechanically couple to each of the individual wellheads 12, as described above. More specifically, the CSW adapter system 54 may be axially lowered down onto the multiple wellheads 12, as shown by arrows 106, such that the multiple offset slim connector 60 couples to the multiple wellheads 12. However, as described above, the CSW adapter system 54 will not be axially lowered onto the multiple wellheads 12 all at once. Rather, the individual components of the CSW adapter system 54 may be moved into position around the multiple wellheads 12 in a particular order.

Figure 8:
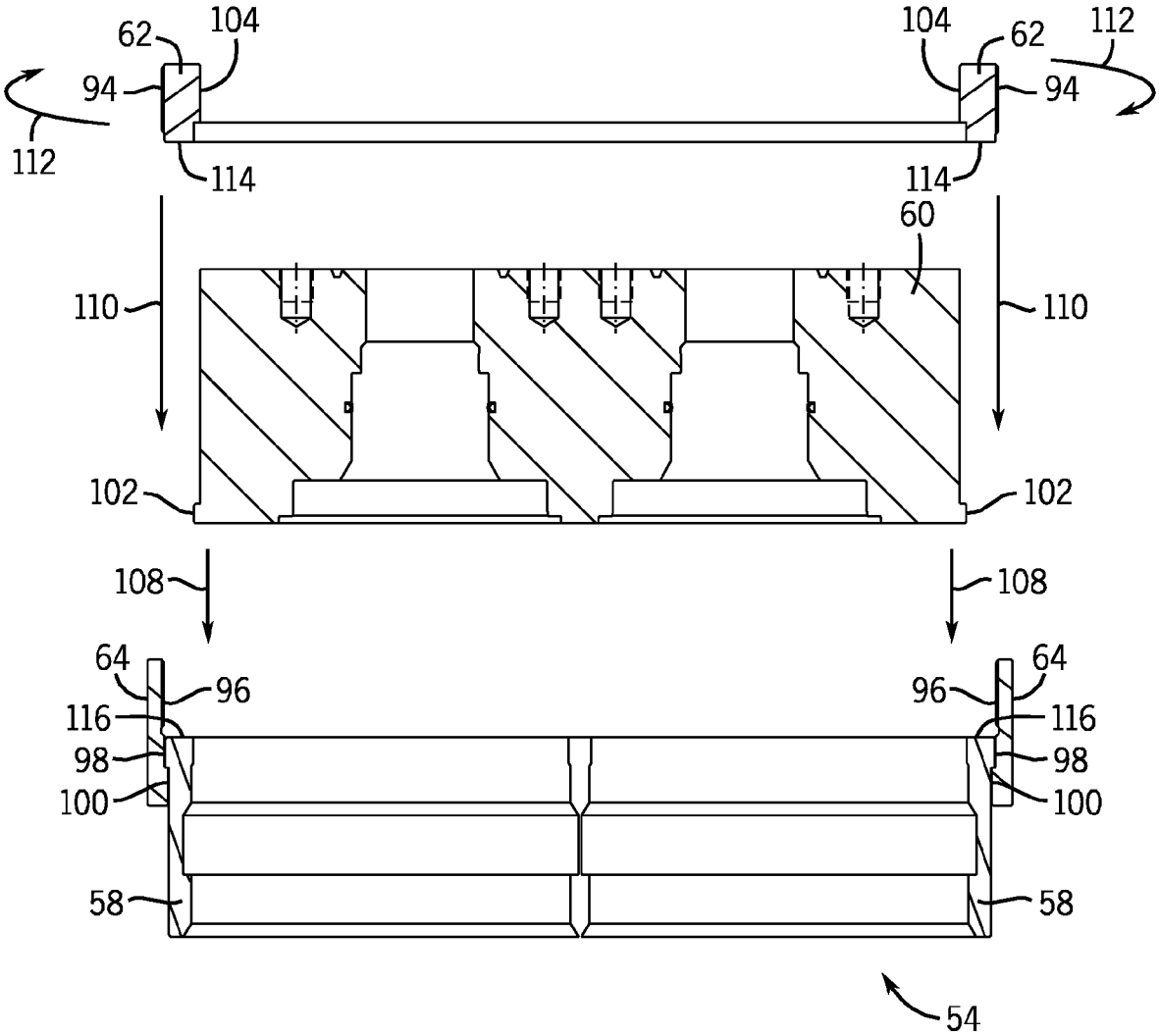
FIG. 8 is a cross-sectional side view of an embodiment of a body lock ring, a multiple offset slim connector, a hold down ring, and a union ring of the CSW adapter system separated from each other, illustrating the order and manner in which they may be connected to each other.

For instance, FIG. 8 depicts a cross-sectional side view of an embodiment of the body lock ring 58, the multiple offset slim connector 60, the hold down ring 62, and the union ring 64 of the CSW adapter system 54 separated from each other, illustrating the order and manner in which these components may be connected to each other around the multiple wellheads 12. In particular, in certain embodiments, the body lock ring 58 and the union ring 64 may be axially lowered onto the multiple wellheads 12 first (i.e., prior to the multiple offset slim connector 60 and the hold down ring 62). As described above, the body lock ring 58 may be locked into position relative to the wellhead lock rings 56 associated with the multiple wellheads 12 using the locking mechanisms 72 described in FIGS. 5 and 6. The union ring 64 may be axially lowered into position around the multiple wellheads 12 simultaneously with the body lock ring 58 primarily because the lip 98 and the notch 100 of the body lock ring 58 and the union ring 64, respectively, would generally prevent the union ring 64 from being lowered over the body lock ring 58 after the body lock ring 58 is locked into position relative to the wellhead lock rings 56.

Once the body lock ring 58 is secured around the multiple wellheads 12, the multiple offset slim connector 60 may be axially lowered onto the multiple wellheads 12 as illustrated by arrows 108. Further, once the multiple offset slim connector 60 has been axially lowered onto the multiple wellheads 12, the hold down ring 62 may be positioned around the multiple offset slim connector 60 as illustrated by arrows 110. In particular, the hold down ring 62 may be axially lowered such that threading 94 on a radially outward face of the hold down ring 62 engages with threading 96 on a radially inward face of the union ring 64. As described above and illustrated by arrows 112, by rotating the hold down ring 62 relative to the union ring 64 by a relatively small amount (e.g., a quarter-turn or half-turn), the threading 94, 96 may ensure that the multiple offset slim connector 60 is secured in place axially relative to the multiple wellheads 12. In particular, the notch 104 of the hold down ring 62 may exert an axially downward force on the lip 102 of the multiple offset slim connector 60 when the hold down ring 62 and the union ring 64 are engaged together via the threading 94, 96. Once the hold down ring 62 and the union ring 64 are fully engaged via the threading 94, 96, an axially downward face 114 of the hold down ring 62 may abut an axially upward face 116 of the body lock ring 58. In other embodiments, the multiple offset slim connector 60 and/or the hold down ring 62 may be pre-loaded, such that the axially downward force will be applied automatically.

Figure 9:
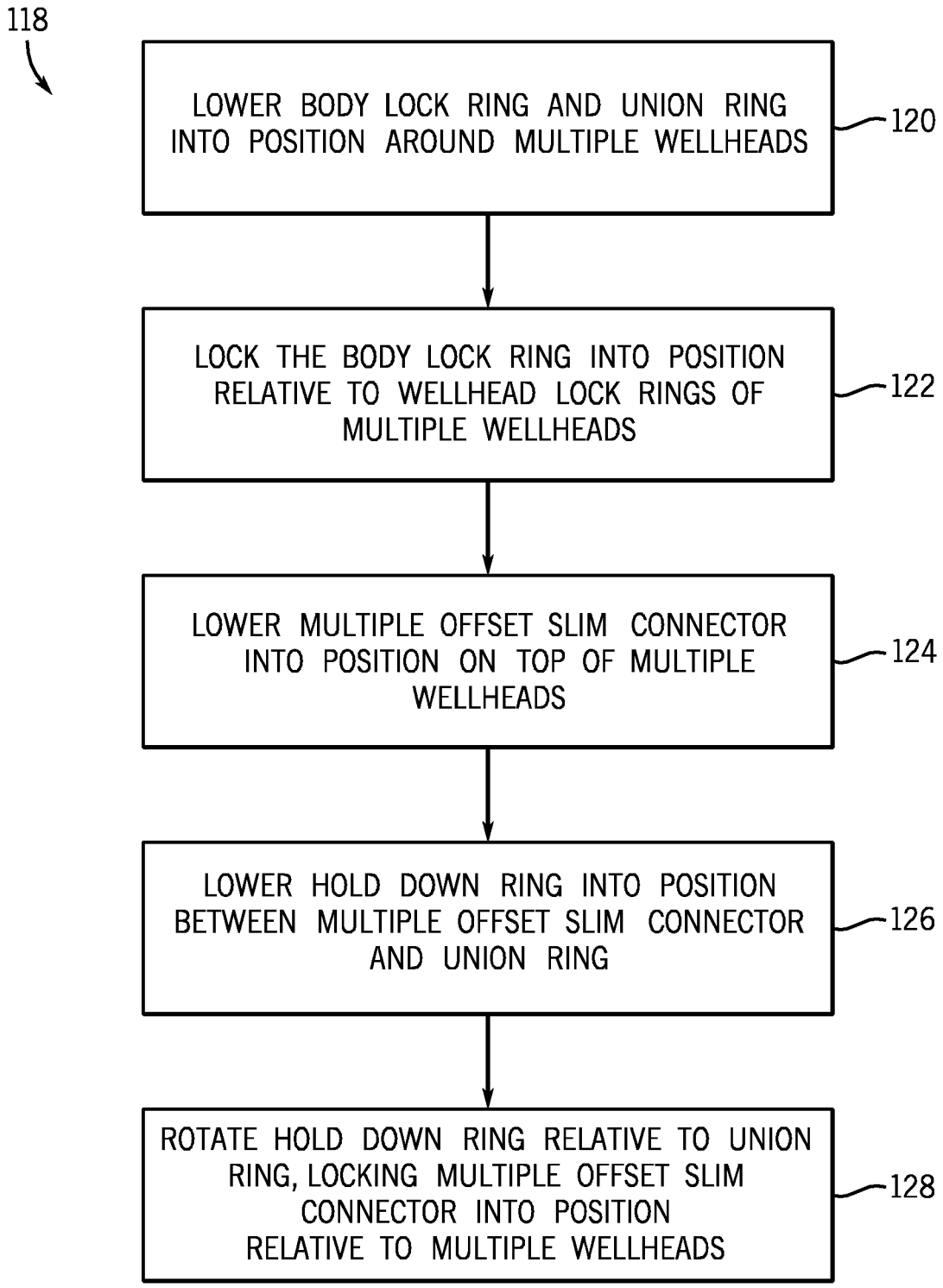
FIG. 9 is a flow diagram of an exemplary embodiment of a method for connecting the CSW adapter system to the multiple wellheads.

FIG. 9 depicts a flow diagram of an exemplary embodiment of a method 118 for connecting the CSW adapter system 54 to the multiple wellheads 12. In block 120, the body lock ring 58 and the union ring 64 may be axially lowered into position around multiple wellheads 12. Once the body lock ring 58 and the union ring 64 have been axially lowered into position, in block 122, the body lock ring 58 may be locked into position relative to the wellhead lock rings 56 of the multiple wellheads 12. The process of locking the body lock ring 58 into position relative to the wellhead lock rings 56 may include manipulating the locking mechanisms 72 described in greater detail above with respect to FIGS. 5 and 6.

Once the body lock ring has been locked into position relative to the wellhead lock rings 56, in block 124, the multiple offset slim connector 60 may be axially lowered into position on top of the multiple wellheads 12. Once the multiple offset slim connector 60 has been axially lowered into position, in block 126, the hold down ring 62 may be axially lowered into position between the multiple offset slim connector 60 and the union ring 64. However, as described above, in certain embodiments, the multiple offset slim connector 60 and the hold down ring 62 may be integrated into one piece. In embodiments where the multiple offset slim connector 60 and the hold down ring 62 are separate pieces, the hold down ring 62 may be used to hold the multiple offset slim connector 60 down relative to the multiple wellheads 12 at least in part due to the lip 102 and the notch 104 of the multiple offset slim connector 60 and the hold down ring 62, respectively. Once the hold down ring 62 has been axially lowered into place between the multiple offset slim connector 60 and the union ring 64, in block 128, the hold down ring 62 may be rotated relative to the union ring 64. Doing so may further lock the multiple offset slim connector 60 into position axially relative to the multiple wellheads 12. In particular, as described above, rotating the hold down ring 62 relative to the union ring 64 may cause the threading 94, 96 of the hold down ring 62 and the union ring 64, respectively, to engage. As the threading 94, 96 of the hold down ring 62 and union ring 64 are tightened together, an axially downward force may be exerted from the notch 104 of the hold down ring 62 onto the lip 102 of the multiple offset slim connector 60. This axial force will ensure that the multiple offset slim connector 60 remains locked into position axially relative to the multiple wellheads 12.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system, comprising:

a wellhead connector comprising a plurality of wellhead mounting bores configured to connect with a plurality of wellheads within a single wellhead conductor;

a body lock ring configured to couple to the wellhead connector; and a plurality of wellhead lock rings configured to mount between the body lock ring and the plurality of wellheads.

2. The system of claim 1, comprising a hold down ring extending circumferentially about the wellhead connector, wherein the hold down ring is configured to block axial movement of the wellhead connector relative to the plurality of wellheads.

3. The system of claim 2, wherein a lip on a radially outward face of the wellhead connector is configured to axially abut a notch on a radially inward face of the hold down ring.

4. The system of claim 2, comprising a union ring having a first threading on a radially inward face, wherein the hold down ring has a second threading on a radially outward face, and the first threading is configured to engage with the second threading.

5. The system of claim 1, comprising a union ring configured to couple the body lock ring to the wellhead connector.

6. The system of claim 5, wherein the union ring comprises threads coaxial with an axis of the wellhead connector, and the union ring is disposed circumferentially about the body lock ring.

7. The system of claim 5, wherein a lip on a radially outward face of the body lock ring is configured to axially abut with a notch on a radially inward face of the union ring.

8. The system of claim 1, wherein the body lock ring is configured to be locked into position by the plurality of wellhead lock rings, wherein each of the plurality of wellhead lock rings is associated with a respective wellhead of the plurality of wellheads.

9. The system of claim 1, wherein the body lock ring extends circumferentially about the wellhead connector and the plurality of wellhead lock rings.

10. The system of claim 1, comprising the multiple wellheads, wherein the wellhead connector at least partially holds the multiple wellheads, and the plurality of wellhead mounting bores are coaxial with bores of the multiple wellheads.

11. A system, comprising:

a wellhead connector configured to connect with multiple wellheads within a single wellhead conductor;

a hold down ring configured to be positioned radially around the wellhead connector and to lock the wellhead connector in position axially on top of the multiple wellheads by applying an axially downward force onto the wellhead connector;

a body lock ring configured to be positioned radially around the multiple wellheads; and a union ring configured to be positioned radially around both the hold down ring and the body lock ring and to lock the hold down ring and the body lock ring in position axially.

12. The system of claim 11, wherein the hold down ring is configured to apply the axially downward force from a notch of the hold down ring to a lip of the wellhead connector.

13. The system of claim 11, wherein a first threading on a radially outward face of the hold down ring is configured to engage with a second threading on a radially inward face of the union ring.

14. The system of claim 13, wherein the hold down ring is configured to apply the axially downward force onto the wellhead connector upon rotation of the hold down ring relative to the union ring via the first and second threading.

15. The system of claim 11, wherein the union ring is configured to lock the hold down ring and the body lock ring in position axially by applying an axially upward force from the union ring onto the body lock ring.

16. The system of claim 15, wherein the union ring is configured to apply the axially upward force from a notch of the union ring to a lip of the body lock ring.

17. The system of claim 11, wherein the body lock ring is configured to be locked in position axially relative to the multiple wellheads using multiple wellhead lock rings, wherein each wellhead lock ring is associated with a respective wellhead.

18. The system of claim 11, wherein the wellhead connector comprises a plurality of wellhead mounting bores configured to connect with multiple wellheads within the single wellhead conductor, and each wellhead mounting bore of the plurality of wellhead mounting bores of the wellhead connector directly mounts with one of the multiple wellheads.

19. A method comprising:

mounting a plurality of wellheads with a single wellhead connector and at least one ring extending circumferentially about the single wellhead connector and the plurality of wellheads, wherein the single wellhead connector comprises a plurality of wellhead mounting bores.

20. The method of claim 19, comprising:

moving a body lock ring and union ring into position radially around the plurality of wellheads;

locking the body lock ring into position axially relative to a plurality of wellhead lock rings, wherein each wellhead lock ring is associated with a respective wellhead of the plurality of wellheads;

moving the single wellhead connector axially into position on top of the plurality of wellheads;

moving a hold down ring into position radially between the single wellhead connector and the union ring; and locking the single wellhead connector into position axially relative to the plurality of wellheads.

21. The method of claim 20, wherein locking the single wellhead connector into position relative to the plurality of wellheads comprises rotating the hold down ring relative to the union ring.

22. The method of claim 20, wherein locking the body lock ring into position relative to the plurality of wellhead lock rings comprises radially expanding the wellhead lock rings from recesses in the plurality of wellheads.

23. The method of claim 19, wherein mounting comprises directly mounting each of the plurality of wellheads at least partially into one of the plurality of wellhead mounting bores of the wellhead connector.

24. The method of claim 19, wherein the at least one ring comprises a body lock ring shared by the plurality of wellheads.

25. The method of claim 19, wherein the at least one ring comprises a union ring having threads coaxial with an axis of the single wellhead connector.

26. A system, comprising:

a wellhead connector comprising a plurality of wellhead mounting bores configured to connect with a plurality of wellheads within a single wellhead conductor, wherein each wellhead mounting bore of the plurality of wellhead mounting bores is configured to axially receive at least a portion of a respective wellhead of the plurality of wellheads;

a body lock ring configured to couple to the wellhead connector; and a plurality of wellhead lock rings configured to mount between the body lock ring and the plurality of wellheads.

27. The system of claim 26, comprising the plurality of wellheads.

* * * * *